US010689926B2

(12) United States Patent
Zhou

(10) Patent No.: US 10,689,926 B2
(45) Date of Patent: Jun. 23, 2020

(54) LOST CIRCULATION ZONE ISOLATING LINER

(71) Applicant: Saudi Arabian Oil Company, Dhahran (SA)

(72) Inventor: Shaohua Zhou, Dhahran (SA)

(73) Assignee: Saudi Arabian Oil Company (SA)

( * ) Notice: Subject to any disclaimer, the term of this patent is extended or adjusted under 35 U.S.C. 154(b) by 58 days.

(21) Appl. No.: 15/469,996

(22) Filed: Mar. 27, 2017

(65) Prior Publication Data

US 2018/0274312 A1 Sep. 27, 2018

(51) Int. Cl.

| | |
|---|---|
| ***E21B 21/00*** | (2006.01) |
| ***E21B 43/08*** | (2006.01) |
| ***E21B 43/10*** | (2006.01) |
| ***E21B 19/00*** | (2006.01) |

(52) U.S. Cl.

CPC ..... *E21B 21/003* (2013.01); *E21B 43/08* (2013.01); *E21B 43/103* (2013.01); *E21B 43/105* (2013.01); *E21B 19/00* (2013.01); *E21B 43/086* (2013.01); *E21B 43/10* (2013.01)

(58) Field of Classification Search

CPC ..... E21B 43/103; E21B 43/10; E21B 43/086; E21B 43/08; E21B 19/00

See application file for complete search history.

(56) References Cited

U.S. PATENT DOCUMENTS

| | | | |
|---|---|---|---|
| 341,327 A | 5/1886 | Fay | |
| 2,804,148 A | 8/1957 | Schremp et al. | |
| 3,134,442 A | 5/1964 | Jennings | |
| 5,411,099 A | 5/1995 | Braddick | |
| 6,244,846 B1 * | 6/2001 | Keller | B29C 63/36 118/254 |
| 7,082,998 B2 | 8/2006 | Zamora et al. | |
| 7,159,673 B2 | 1/2007 | Van Dijk | |
| 7,380,595 B2 | 6/2008 | Wetzel et al. | |
| 7,387,174 B2 | 6/2008 | Lurie | |

(Continued)

OTHER PUBLICATIONS

Accessed Azom Materials on Jul. 17, 2018, via https://www.azom.com/article.aspx?ArticleID=6769 (Year: 2013).*

(Continued)

*Primary Examiner* — D. Andrews
*Assistant Examiner* — Manuel C Portocarrero
(74) *Attorney, Agent, or Firm* — Bracewell LLP; Constance R. Rhebergen

(57) ABSTRACT

A method and system for remediating a lost circulation zone in a wellbore. A flexible liner is deployed adjacent the lost circulation zone that blocks fluid communication between the wellbore and surrounding formation. The liner material has a designated yield and tensile strength, so that in response to pressure applied in the wellbore the liner flexes and conforms to contours in the wellbore. The liner remains intact during deformation to maintain the flow barrier between the wellbore and formation. The liner is set in the wellbore with a bottom hole assembly that includes an outer housing for protecting the liner during the trip downhole. Drill pipe can be used for deploying the bottom hole assembly, and for conveying pressurized fluid for setting the liner. An expander is included with the bottom hole assembly for mechanically conforming the liner to the wellbore sidewalls.

19 Claims, 15 Drawing Sheets

(56) References Cited

U.S. PATENT DOCUMENTS

| | | | | |
|---|---|---|---|---|
| 7,478,651 | B2 | 1/2009 | Simpson | |
| 8,967,280 | B2 * | 3/2015 | Doane | E21B 33/1291 166/120 |
| 9,353,584 | B2 | 5/2016 | Allen et al. | |
| 9,470,059 | B2 | 10/2016 | Zhou | |
| 2010/0032169 | A1 * | 2/2010 | Adam | E21B 43/103 166/382 |
| 2011/0056703 | A1 * | 3/2011 | Eriksen | E21B 7/20 166/381 |
| 2013/0068478 | A1 * | 3/2013 | Allen | E21B 43/103 166/380 |
| 2013/0068481 | A1 | 3/2013 | Zhou | |
| 2014/0124199 | A1 | 5/2014 | Gorrara et al. | |
| 2015/0129205 | A1 * | 5/2015 | Hofman | E21B 34/063 166/250.01 |
| 2015/0308250 | A1 * | 10/2015 | Anders | E21B 33/12 166/308.2 |

OTHER PUBLICATIONS

International Search Report and Written Opinion, PCT/US2018024558 dated Jun. 26, 2018.

* cited by examiner

LOST CIRCULATION ZONE ISOLATING LINER

BACKGROUND OF THE INVENTION

1. Field of Invention

The present disclosure relates to a liner for isolating a wellbore from a lost circulating zone. More specifically, the present disclosure relates to repairing a lost circulation zone in a wellbore with a flexible liner that conforms to a profile of a wellbore sidewall.

2. Description of Prior Art

Hydrocarbon producing wellbores extend subsurface and intersect subterranean formations where hydrocarbons are trapped. The wellbores are usually formed by drilling systems that include a drill string made up of a drill bit mounted to a length of interconnected pipe. Typically a top drive or rotary table above the opening to the wellbore rotates the drill string. Cutting elements on the drill bit scrape the bottom of the wellbore as the bit is rotated and excavate material thereby deepening the wellbore. Drilling fluid is typically pumped down the drill string and directed from the drill bit into the wellbore; the drilling fluid then flows back up the wellbore in an annulus between the drill string and walls of the wellbore. Cuttings are produced while excavating and are carried up the wellbore with the circulating drilling fluid.

While drilling the wellbore mudcake typically forms along the walls of the wellbore that results from residue from the drilling fluid and/or drilling fluid mixing with the cuttings or other solids in the formation. The permeability of the mudcake generally isolates fluids in the wellbore from the formation. Seepage of fluid through the mudcake can be tolerated up to a point. Occasionally cracks in a wall of the wellbore allow free flow of fluid (lost circulation) between the wellbore and adjacent formation. Corrective action is required when the magnitude of the lost circulation compromises well control. The cracks may be from voids in the rock formation that were intersected by the bit, or can form due to large differences in pressure between the formation and the wellbore.

Typically after encountering severe circulation losses drilling is stopped and conventional heavy concentration lost circulation material ("LCM") is pumped downhole with the intention to plug the cracks in the rock formation to mitigate mud losses, however to avoid plugging the drill string, in particular, downhole measurement while drilling (MWD), logging while drilling (LWD) tool and even drill bit nozzles, a circulating tool, sometimes referred to as a "PBL sub" is often activated at this stage to divert the LCM loaded fluids into the lost circulation zone. If the lost circulation problem is significant, a plug of cement slurry or other material is set in the wellbore adjacent the lost circulation zone, which is then later drilled out. In some instances, the formation surrounding the wellbore contains natural fractures having such a significant volume that the lost circulation material pumped downhole migrates into the fracture(s) before being set. While LCM, or bridging material, is available that solidifies at certain downhole temperatures or pressures, many potential obstacles hinder these materials from being fully effective. For example, the circulation zones are often at depths requiring a significant time passage before the material can be pumped to the affected zone. Further, a large amount of mud in the wellbore between surface and the depth of the lost circulation zone that can dilute the LCM or bridging material. Also the large static head existing downhole further destabilizes the lost circulation zone.

SUMMARY OF THE INVENTION

Disclosed herein is a method of conducting operations in a wellbore, that in one example includes deploying a tubular liner in the wellbore and adjacent a lost circulation zone in the wellbore, urging the liner radially outward into contact with sidewalls of the wellbore, and conforming the liner with a contour of the wellbore by pressing the liner against the sidewalls of the wellbore to remediate the lost circulation zone. The method can also include extending a drill bit through the liner and deepening the wellbore. In an example, the material of the liner includes interstitial free steel having a tensile strength of around 30,000 pounds per square inch. The step of urging the liner radially outward can involve pressurizing an inside of the liner. In one example, the step of conforming the liner with a contour of the wellbore involves applying a mechanical force against an inner surface of the liner. The step of conforming the liner with a contour of the wellbore optionally includes bulging the liner radially outward into a fracture that extends into a formation surrounding the wellbore. The method can further include providing a protective housing around the liner while deploying the liner into the wellbore. The liner and housing can be a portion of a bottom hole assembly, the method can further involve applying pressure to the bottom hole assembly to project the liner axially from an open end of the housing. In an alternative, the liner has an outer periphery that follows an undulating path when the liner is being deployed downhole.

Also described herein is a system for use in conducting operations in a wellbore, and that in one example includes an annular housing, a piston assembly slidably set within the housing, an annular liner detachably attached to the piston assembly and selectively depending into the housing, and a liner shoe on an end of the liner distal from the piston assembly and which defines a sealed space within the liner, so that when pressure is applied to the sealed space, the liner expands radially outward into contact with an inner surface of the wellbore. In one embodiment, the liner is made of a material having a tensile strength of about 30,000 pounds per square inch, so that by applying pressure to the sealed space the liner conforms to a profile of sidewalls of the wellbore, and bulges into fractures that extending from the sidewalls and into a formation that surrounds the wellbore. An expander can optionally be included and which selectively expands into contact with the liner to mold the liner against sidewalls of the wellbore. In an alternative, an end of the housing is in communication with a pressure source, so that when pressure is supplied from the pressure source, the piston is slidingly urged within the housing to deploy the liner from within the housing. A tubular member can be included that has an end attached to the piston assembly and extending into the liner, and a burst orifice on the tubular member, so that when pressure is supplied to the tubular member that exceeds a burst pressure of the burst orifice, pressure is applied to an inside of the liner that radially expands the liner into conforming contact with sidewalls of the wellbore. Optionally included is a dog assembly mounted onto the piston assembly, and that projects radially outward into a profile formed on an inner circumference of the housing. In one embodiment the dog assembly includes a dog member and a resilient member that urges the dog member into the profile. In one example, a pressure actuated rod is set in the housing that selectively moves adjacent the dog assembly thereby rotationally affixing the housing and the piston assembly.

BRIEF DESCRIPTION OF DRAWINGS

Some of the features and benefits of the present invention having been stated, others will become apparent as the description proceeds when taken in conjunction with the accompanying drawings, in which.

Figure 2:
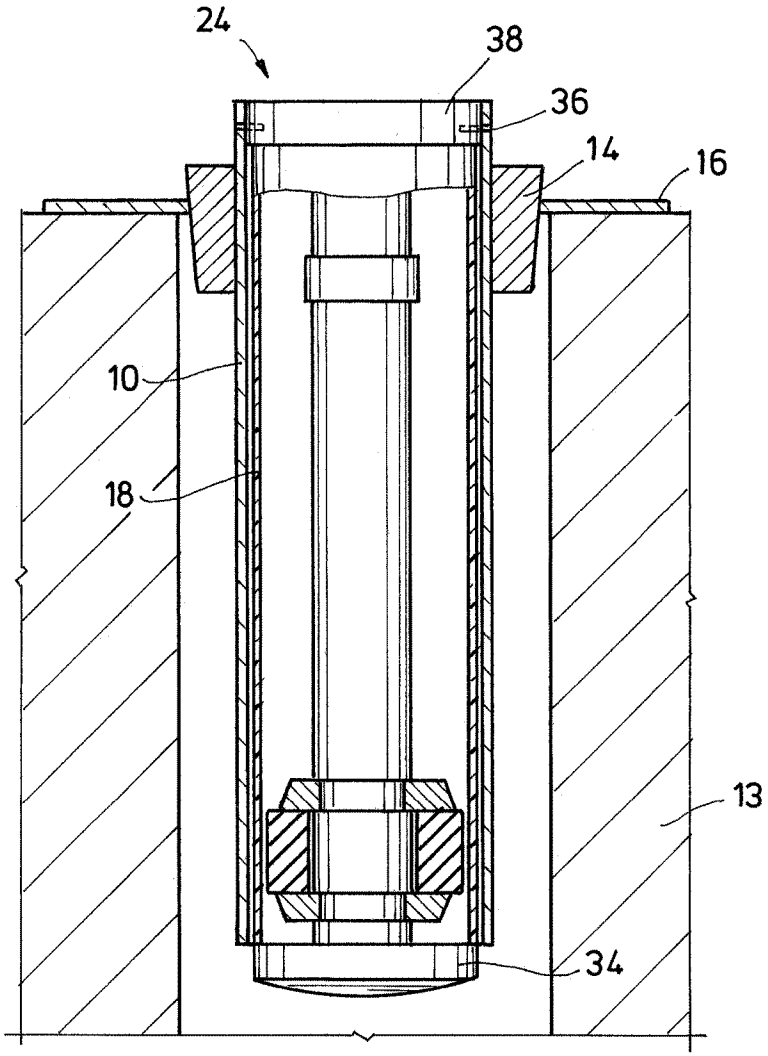
FIGS. 1-3 are side sectional views of example steps of assembling an embodiment of a bottom hole assembly for deploying a liner downhole.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
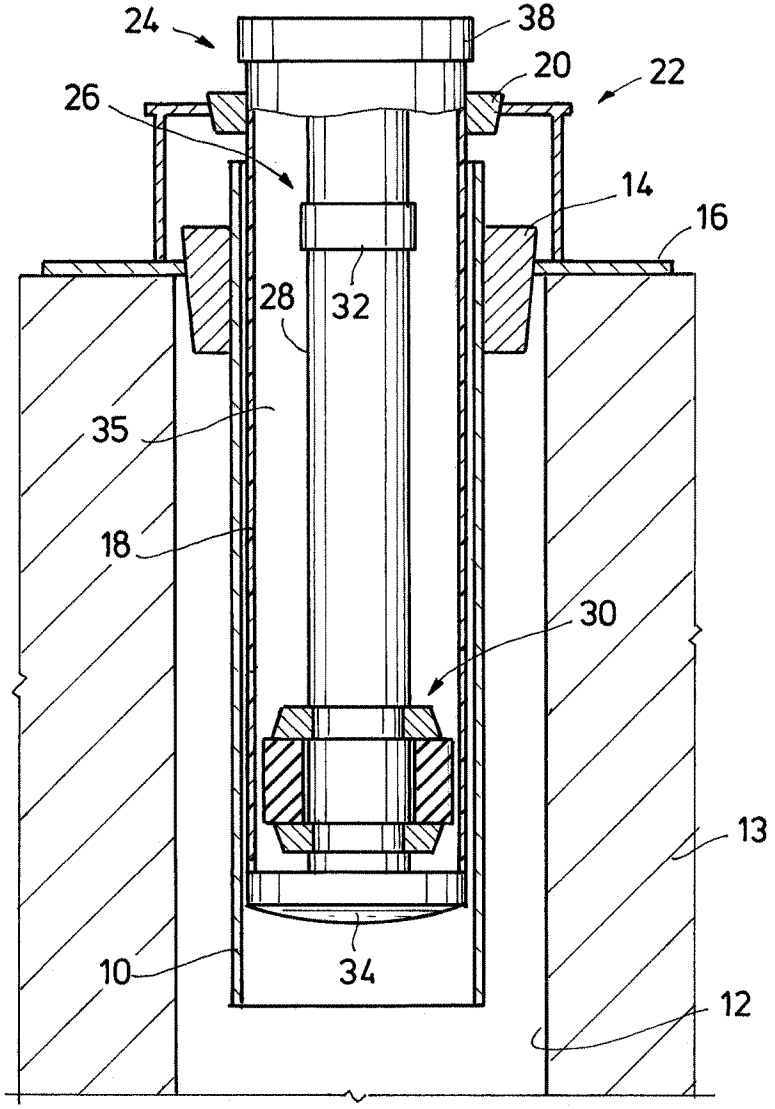

Illustrated in FIGS. 1-3 and as described in detail below is an example of assembling a downhole system. FIG. 1 shows in a side partial sectional view one example of a housing 10 being inserted into a wellbore 12, where wellbore 12 intersects a subterranean formation 13. Housing 10 is shown being suspended in wellbore 12 on slips 14. Slips 14 are schematically shown supported on a rig floor 16 which is shown adjacent an opening of wellbore 12. An example of a liner 18 is shown being landed within the housing 10 and supported on hand slips 20. In the illustrated example, housing 10 and liner 18 are each annular members with a curved outer circumference, an axial bore within, and having a length greater than a diameter. Further in this example, housing 10 has a length greater than a length of liner 18. The hand slips 20 are in turn suspended above the wellbore 12 on support 22, that in one example can be a false rotary table. An end of liner 18 projecting out of wellbore 12 is shown coupled to a piston assembly 24 that provides a sealing interface on this end of liner 18. The example of the piston assembly 24 shown is a generally cylindrical member with an outer diameter greater than an outer diameter of liner 18 and which is substantially the same as an inner diameter of housing 10. Thus when piston assembly 24 is inserted into housing 10, a sealing interface can be formed along where the outer periphery of piston assembly 24 contacts the inner diameter of housing 10. Shown disposed within liner 18 is an example of a deployment system 26 that includes a body 28 and with an expander 30 mounted to body 28 at an axial location distal from piston assembly 24. In an embodiment, body 28 of deployment system 26 has an annular configuration and is generally coaxial with liner 18. A slip sub 32 is integrally formed on body 28 to allow for selective changes of axial length of body 28. A liner shoe 34 is shown mounted on an end of liner 18 distal from piston assembly 24. In the example depiction, liner shoe 34 is a cup like member with an open end coupled with an end of liner 18 distal from piston assembly 24. The liner shoe 34 and piston assembly 24 define a sealed space 35 inside of liner 18.

Referring now to FIG. 2, shown in a partial side sectional view is where the piston assembly 24 is inserted into housing 10 so that the attached liner 18 is inserted deeper into housing 10. Here, the hand slips 20 and support 22 of FIG. 1 have been removed thereby allowing liner 18 and piston assembly 24 to slide axially within housing 10. Further added in the example of FIG. 2 are shear pins 26 that couple housing 10 to piston assembly 24, and that project radially through a sidewall of housing 10 and into piston assembly 24. A piston head 38 makes up the section of the piston assembly 24 intersected by shear pins 36.

Figure 3:
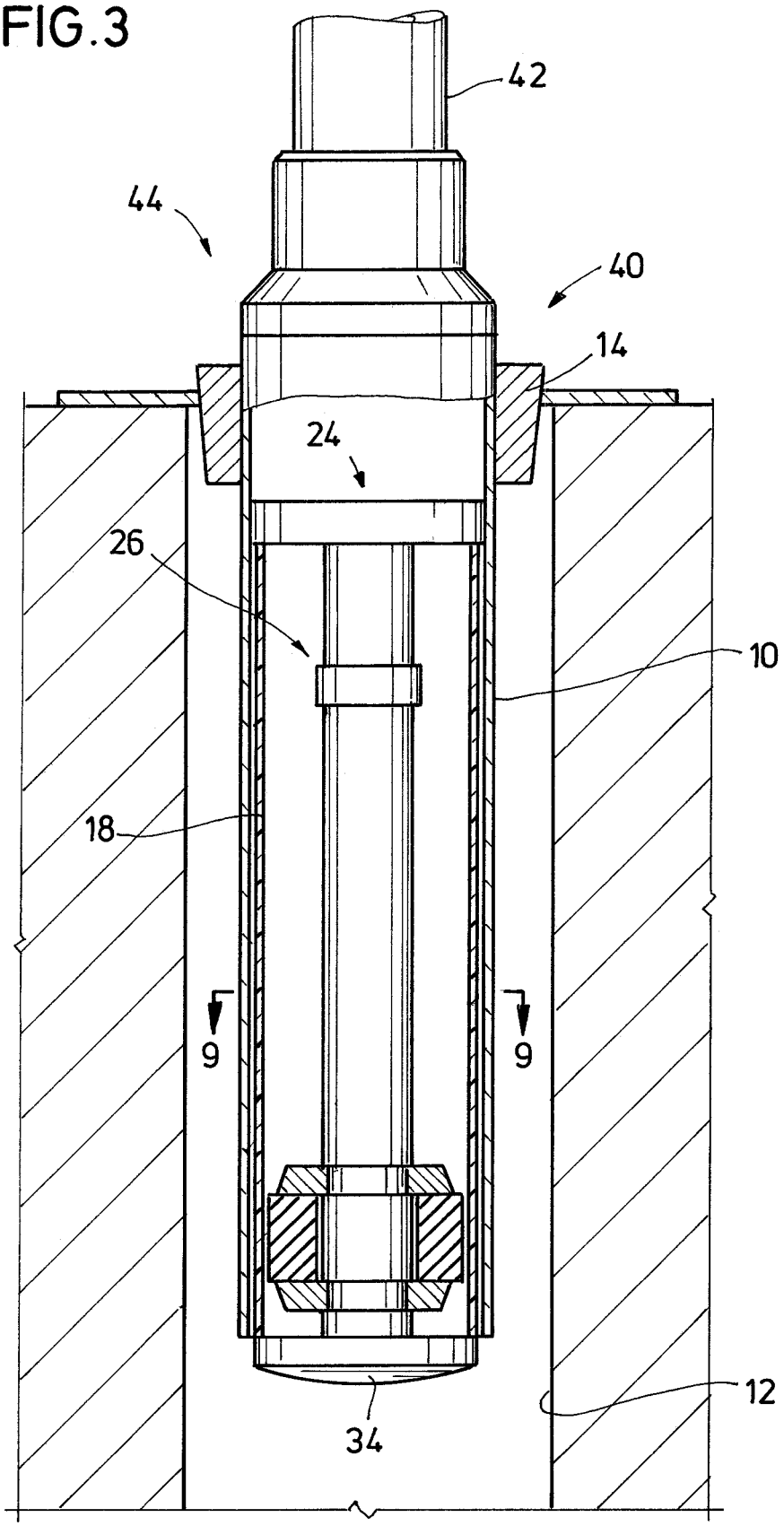

FIG. 3 shows in a side partial sectional view a schematic example of a cross over 40 being mounted to an end of housing 10 distal from liner shoe 34. Cross over 40 provides a mean for connecting the housing 10 and liner 18 to a drill pipe 42. The assembly of the housing 10, piston assembly 24, and deployment system 26 define an example of a bottom hole assembly 44 as will be described in more detail below is used for remediating a lost circulation zone within wellbore 12. Moreover, the addition of the drill pipe 42 provides a means for deploying and retrieving the bottom hole assembly 44 into and from wellbore 12.

Figure 4A:
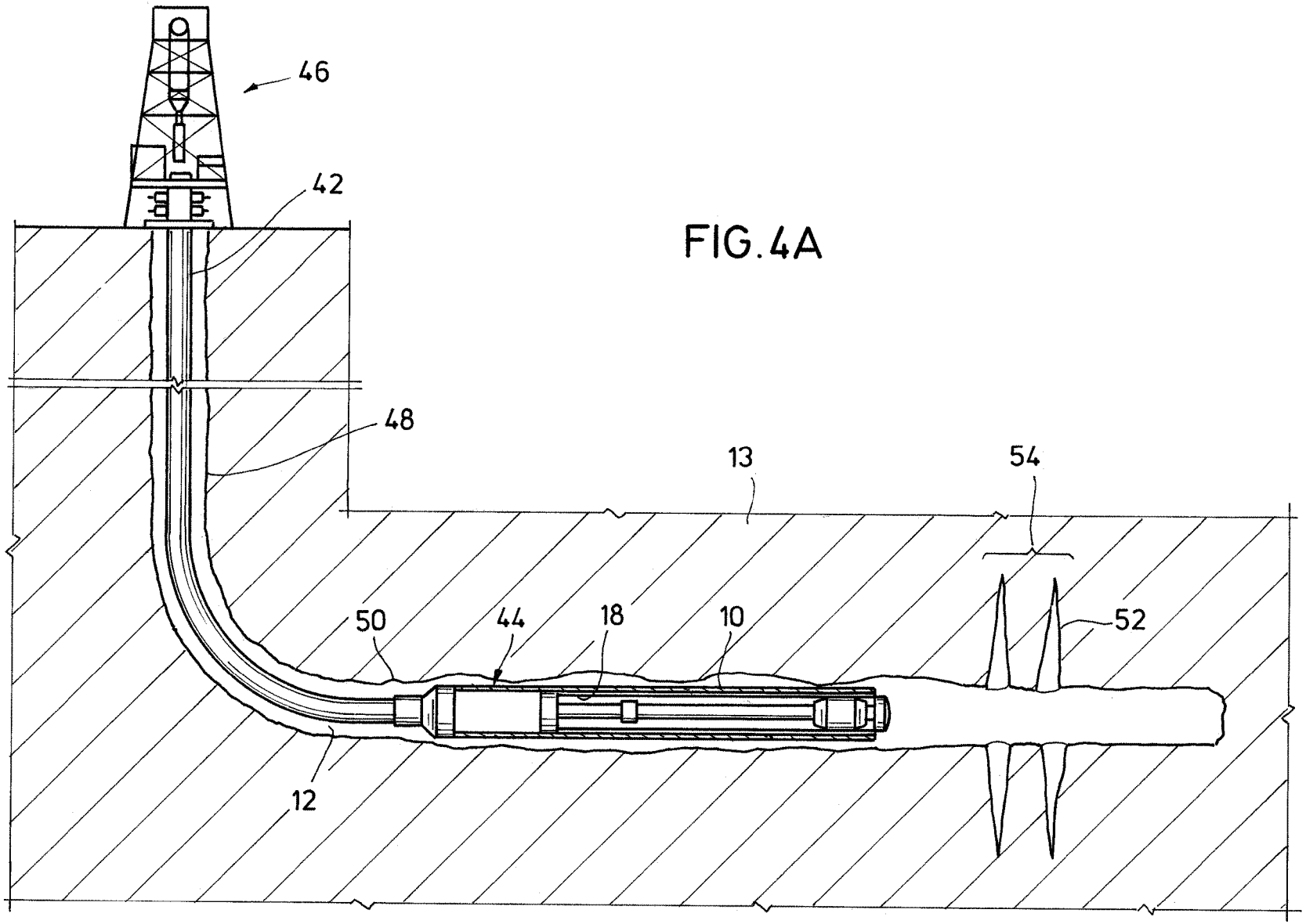
FIGS. 4A-4G are side sectional views of example steps of deploying the liner of FIG. 1 in a wellbore and with the bottom hole assembly.

Depicted in a side partial sectional view in FIG. 4A is an example of the bottom hole assembly 44 being deployed on drill pipe 42 within wellbore 12. In this example, an upper end of the drill pipe 42 is supported from a drilling rig 46 that is set over an opening of the wellbore 12. Additionally, the wellbore 12 includes a vertical section 48 that is adjacent the opening of the wellbore 12, and a deviated section 50 that extends generally horizontally within formation 13 from an end of vertical section 48. Here, fractures 52 are shown projecting radially outward from wellbore 12 into formation 13. These fractures 52, which can occur naturally or through a fracking process, define an area where fluid in the wellbore 12 flows freely into formation 13 thereby forming a loss circulation zone 54. As discussed in more detail below, deploying the liner 18 adjacent a loss circulation zone 54 can constitute a barrier for remediating fluid losses from wellbore 12.

Figure 4B:
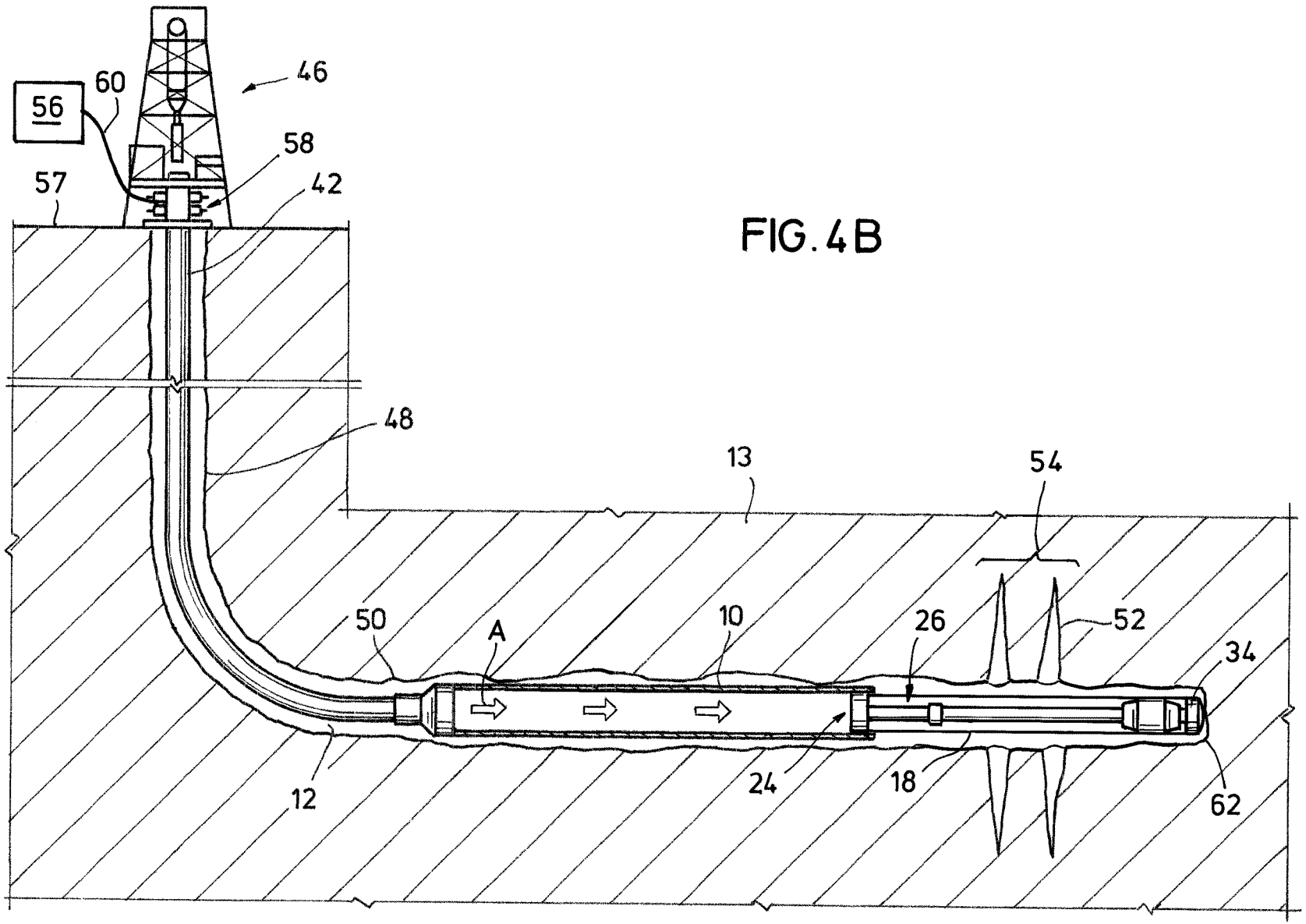

Illustrated in FIG. 4B is a side partial sectional view of an example of another step of the wellbore operation described herein. In this example step, the piston assembly 24, deployment system 26, and liner 18 are shown having been urged axially outward from within housing 10 and adjacent to the loss circulation zone 54. Force for axially deploying the liner 18 from housing 10 can optionally be provided by a pressure source 56 shown on surface 57 outside an opening of wellbore 12. In this embodiment pressure source 56 is in communication with the drill pipe 42 via a wellhead assembly 58 on surface 57. Line 60 communicates pressurized fluid from pressure source 56 to wellhead assembly 58 that is subsequently transferred to drill pipe 42 and introduced into housing 10. After deploying a small ball and circulating it to its landing seat (not shown) within the liner shoe 34, so a closed fluid system is established to allow pressure build-up. Arrows A represent the fluid urging the piston assembly 24 axially within housing 10 thereby projecting liner 18 and deployment system 26 from within housing 10. Further in this example, the liner shoe 34 is proximate a bottom 62 of wellbore 12.

Figure 4C:
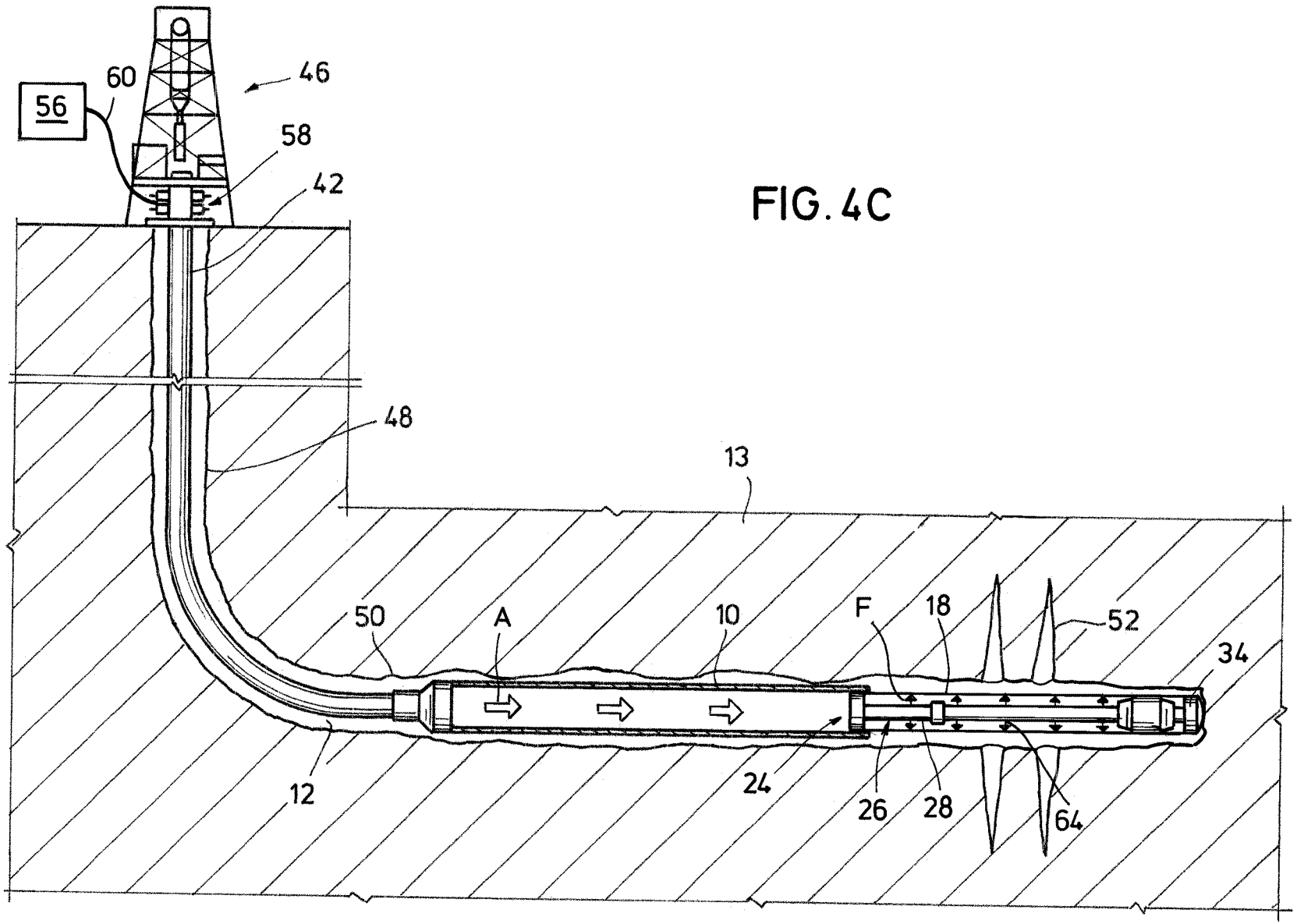
Figure 4D:
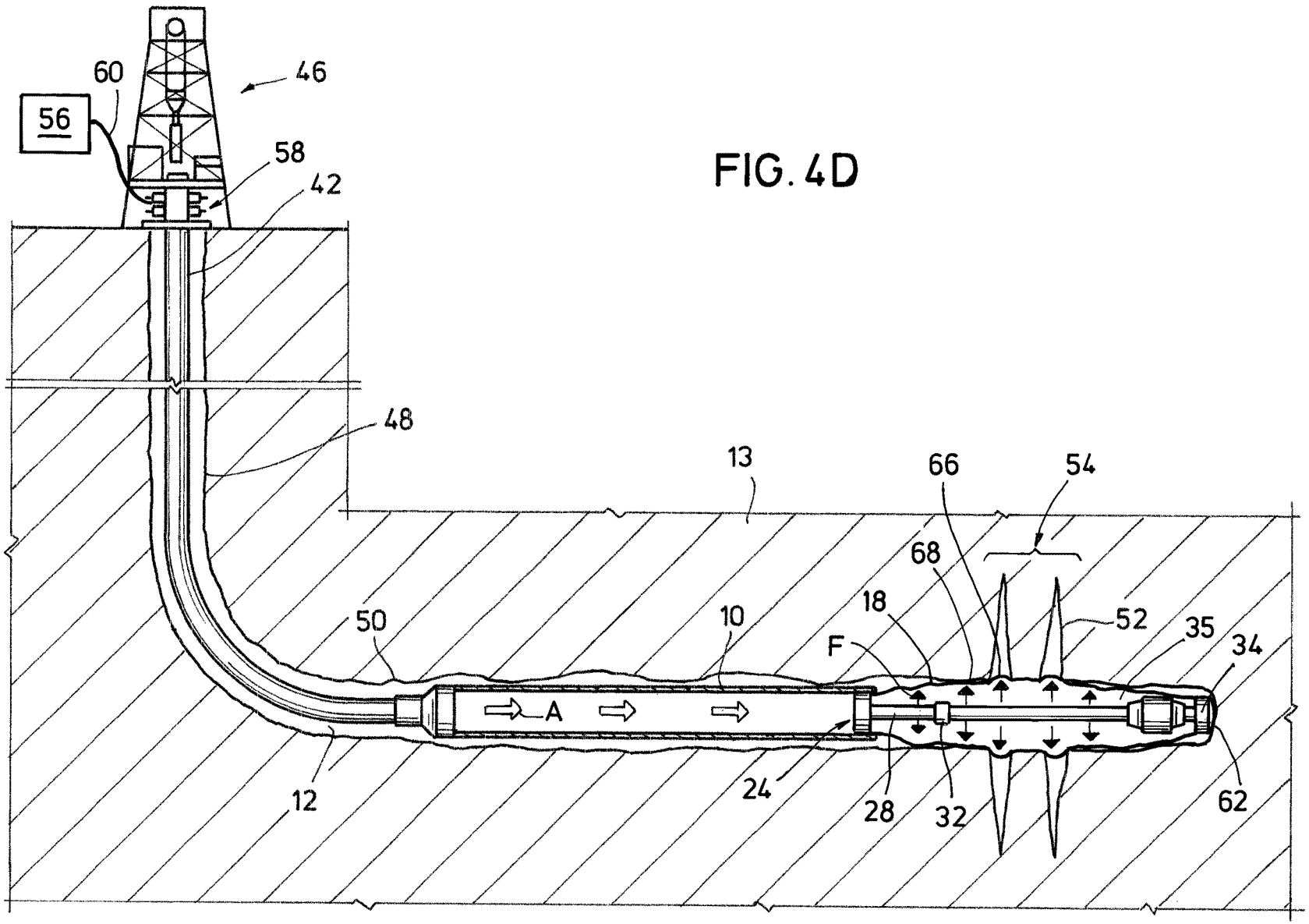

Shown in side sectional view in FIG. 4C is that the fluid from fluid source 56 has entered into the body 28 of deployment system 26 and exceeded a set pressure of rupture disks 64 shown formed at various locations along a sidewall of body 28. Thus fluid F exits the body 28 through the rupture disk 64, and enters into the sealed space 35 defined within liner 18 and bounded on axial ends by piston assembly 24 and liner shoe 34. Subsequently as illustrated in FIG. 4D, the pressure of the fluid F within sealed space 35 causes the liner 18 to project radially outward and into contact with the sidewalls of wellbore 12. Moreover, the prolonged exposure of the liner 18 to the pressure causes bulges 66 within liner 18 that protrude into the fractures 52 and also cause the liner 18 to conform to the contours 68 shown along the open hole wellbore 12. As noted above, the slip sub 32 of FIG. 4D operates to allow the body 28 to contract and expand, thereby compensating for axial changes in length of liner 18 as the radius of liner 18 changes with the application of the pressure within the sealed space 35. In this illustration the body 28 is contracted as the length of liner 18 contracts in response to its expanding radius. In an embodiment, slip sub 32 further maintains a pressure seal internally, and is capable of carrying tubular weight of the below section via a stop ring (not shown). Slip sub 32 is optionally formed from overlapping tubular with a fluid filled chamber, where the inner member has elastomer seal rings at its end, and is slidable on the inner surface if the outer member.

An advantage of the technique employed for placing the liner is that the inner diameter of the wellbore 12 after having been remediated and with the liner 18 set and in place, remains substantially the same as that prior to remediation. As such, the presence of liner 18 as shown set and deployed in the example of FIG. 4D does not hinder subsequent operations within the wellbore 12 as the diameter of the wellbore 12 is not diminished. In one example the material of the liner 18 selectively chosen to be sufficiently pliable to be deformed under the applied pressure of the fluid F, and substantially conform to the contours 68 within wellbore 12. Further, the material of the liner 18 is also chosen to have a sufficient strength so that the liner 18 maintains its structural integrity while and after being deformed so that the barrier between wellbore 12 and formation 14 is sustained to allow for normal operation of the wellbore 12. In one example, material for the liner 18 includes a highly deformable metal, such as a low yield grade of steel, and in an alternative has an expansion ratio that is at least around 50%. One example material can include interstitial free ("IF") steel, such as that having ultra-low carbon content. In an alternative embodiment, ultra-low carbon content is achieved by removing carbon monoxide, hydrogen, nitrogen, and other gasses during steelmaking through a vacuum degassing process. Not to be bound by theory, but it is believed that the lack of interstitial atoms in the atomic structure enables IF steel to have extremely high ductility, ideal for large deformation with excellent formability. Alternative, the material for liner 18 can include mild steel, such as a mild steel with a relatively simple ferritic microstructure, low carbon content, and minimal alloying elements so that it is soft. Example tensile strengths of the IF steel range up to an include about 30,000 pounds per square inch, and are up to and about 40,000 pounds per square inch for the mild steel. In one example, constituents of the IF steel include carbon, silicon, manganese, phosphorus, sulfur, chromium, aluminum, nitrogen, vanadium, nickel, titanium, and iron. Example mass percentages of constituents of the IF steel include carbon at 0.0020, silicon at 0.010, manganese at 0.170, phosphorus at 0.0120, sulfur at 0.080, chromium at 0.040, aluminum at 0.041, nitrogen at 0.0027, vanadium at 0.005, nickel at 0.020, titanium at 0.072, with the balance being iron. In an embodiment, low carbon steel describes steel having a carbon content of from about 0.05 percent by weight up to about 0.3 percent by weight. In one alternative, low carbon steel describes steel having a carbon content of up to about 0.05 weight percent by weight. Liners 18 formed from material in accordance with that described herein can be used in pressurized formations where the pressure differential is up to at least around 1000 to 1500 pounds per square inch, and with a potential collapse pressure that ranges up to around 300 to 500 pounds per square inch. An advantage of forming the liner 18 from steel, with some inherent strength, is the better wear resistance to the expected friction caused by drilling BHA and drill string rotation, hence better enable continued drilling of the remained wellbore lateral to the planned well total depth, rather other alternative choices of soft material, such as aluminum, brass, composite material, and the like.

Figure 4E:
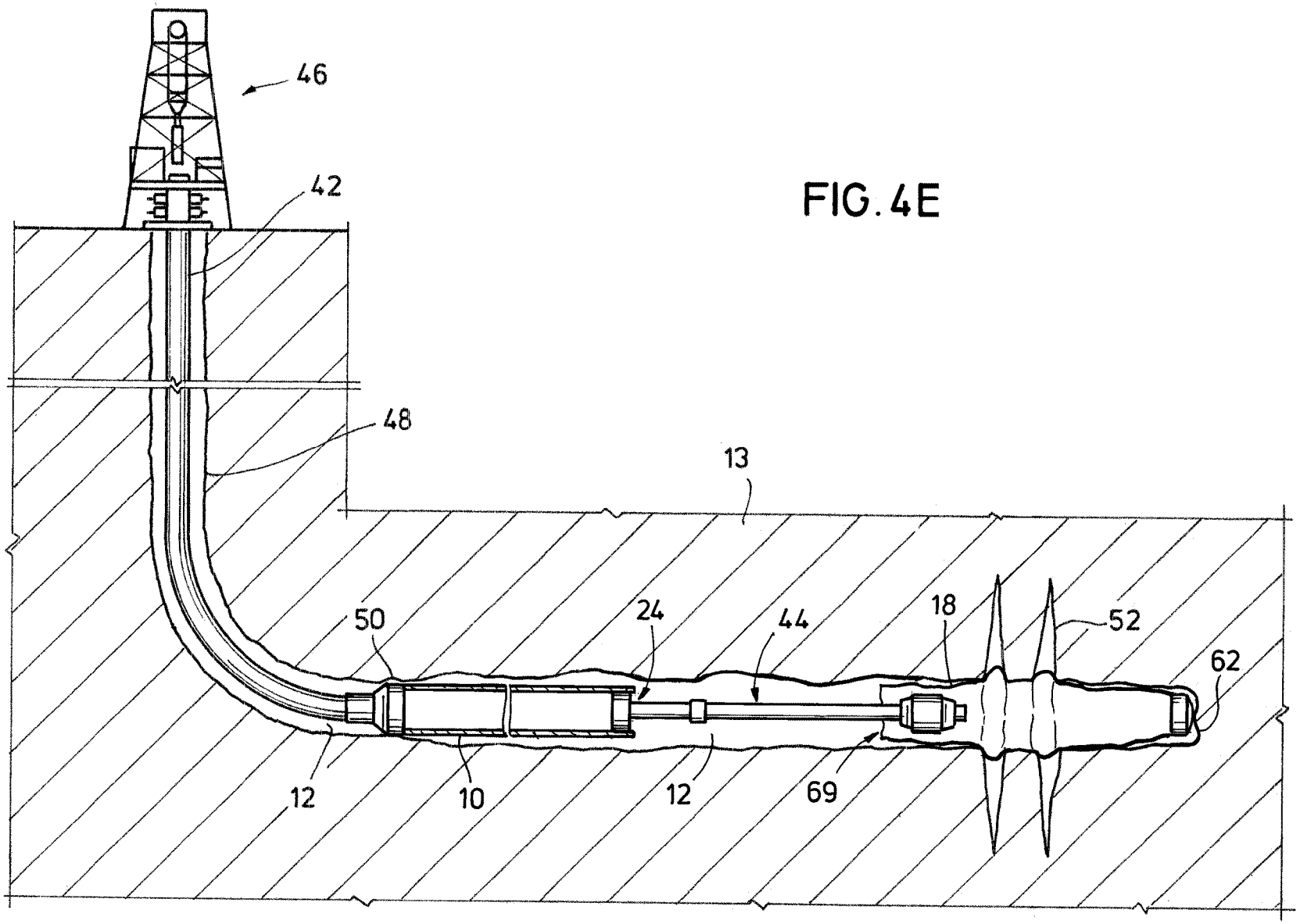
Figure 4F:
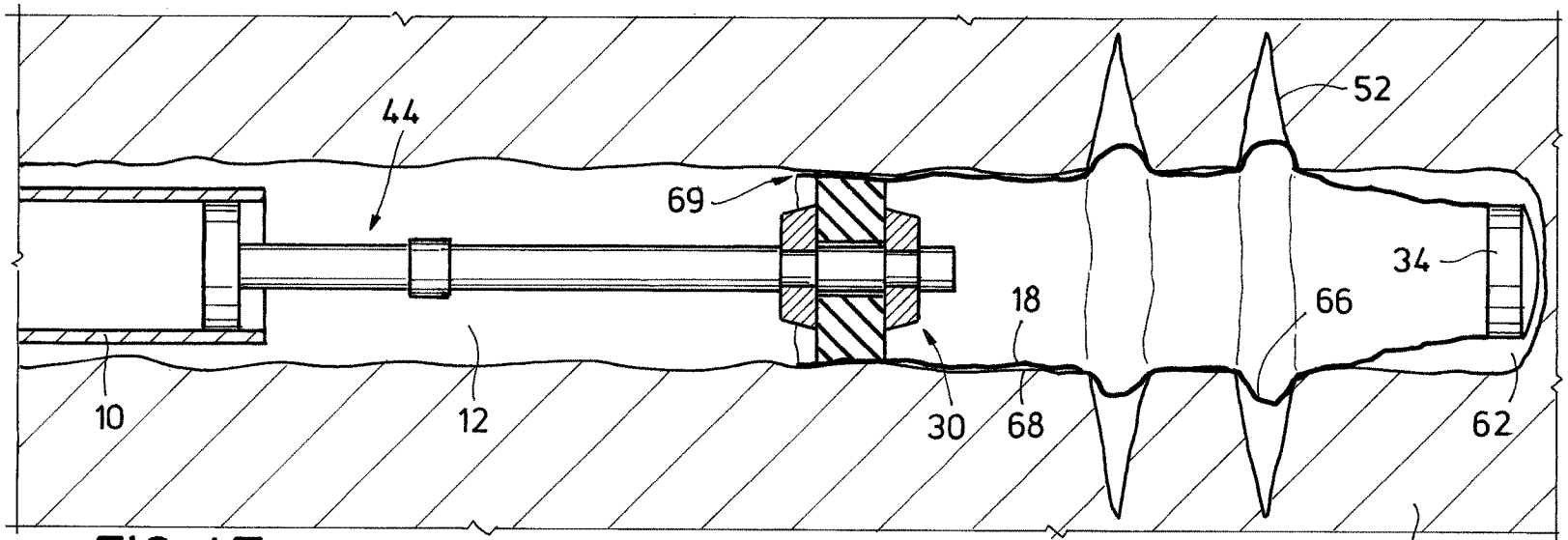

Shown in FIG. 4E is a side partial sectional view of an example step of drawing the bottom hole assembly 44 out from wellbore 12 after having separated the liner 18 from the remaining portion of bottom hole assembly 44. An open end 69 of the liner 18 previously connected to the piston assembly 24 is shown set radially inward and spaced away from the sidewall of the wellbore 12. The spacing between the open end 69 of the liner 18 and sidewall of the wellbore 12 is addressed in the example of FIG. 4F. As shown in this example, the expander 30 radially expands into contact with the open end 69 of liner 18 to urge the end 69 into conforming contact with the sidewall of the wellbore 12. An advantage of a bottom hole assembly 44 having an expander 30 is the ability to maintain the entire length of the liner 18 at substantially the same contour and shape of the sidewalls of the wellbore 12. As such, the possibility of contacting the open end 69 of the liner 18 during subsequent wellbore operations is diminished by employing the use of the expander 30. Optionally, the expander 30 can be operated to apply a radial outward force along the entire length of the liner 18 to better secure the liner 18 in the wellbore 12, and reshape the liner 18 to approximate the contour of the sidewall of the wellbore 12.

Figure 4G:
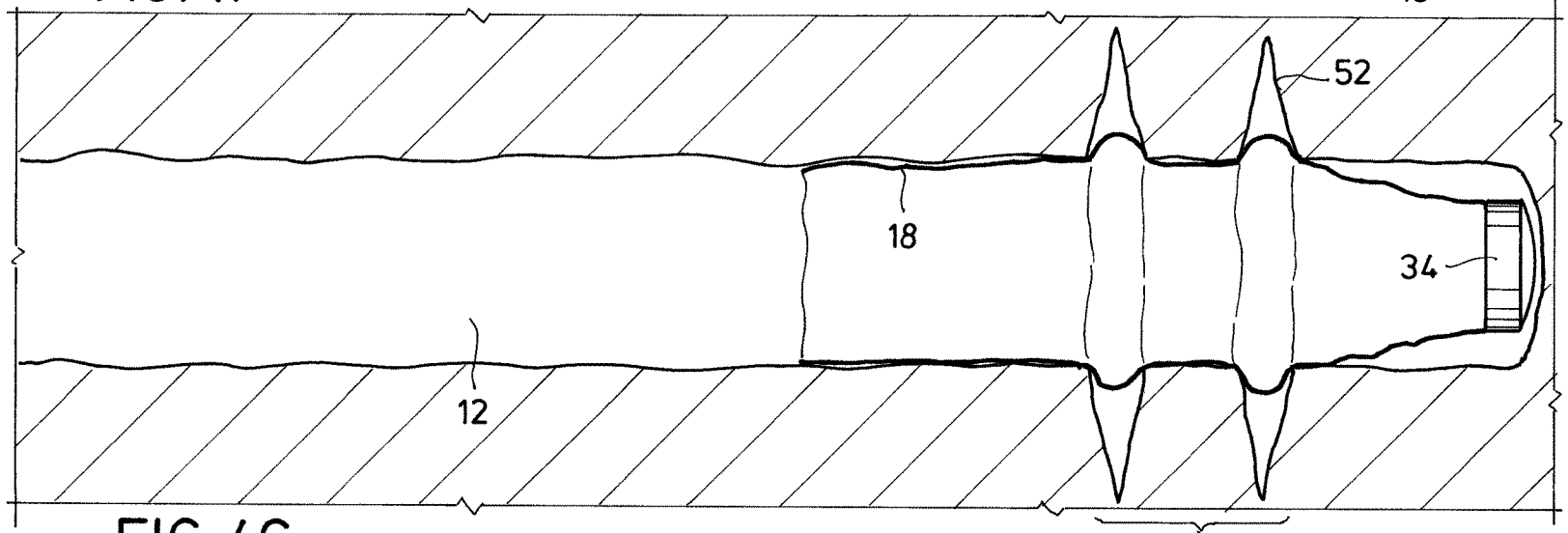
Figure 4H:
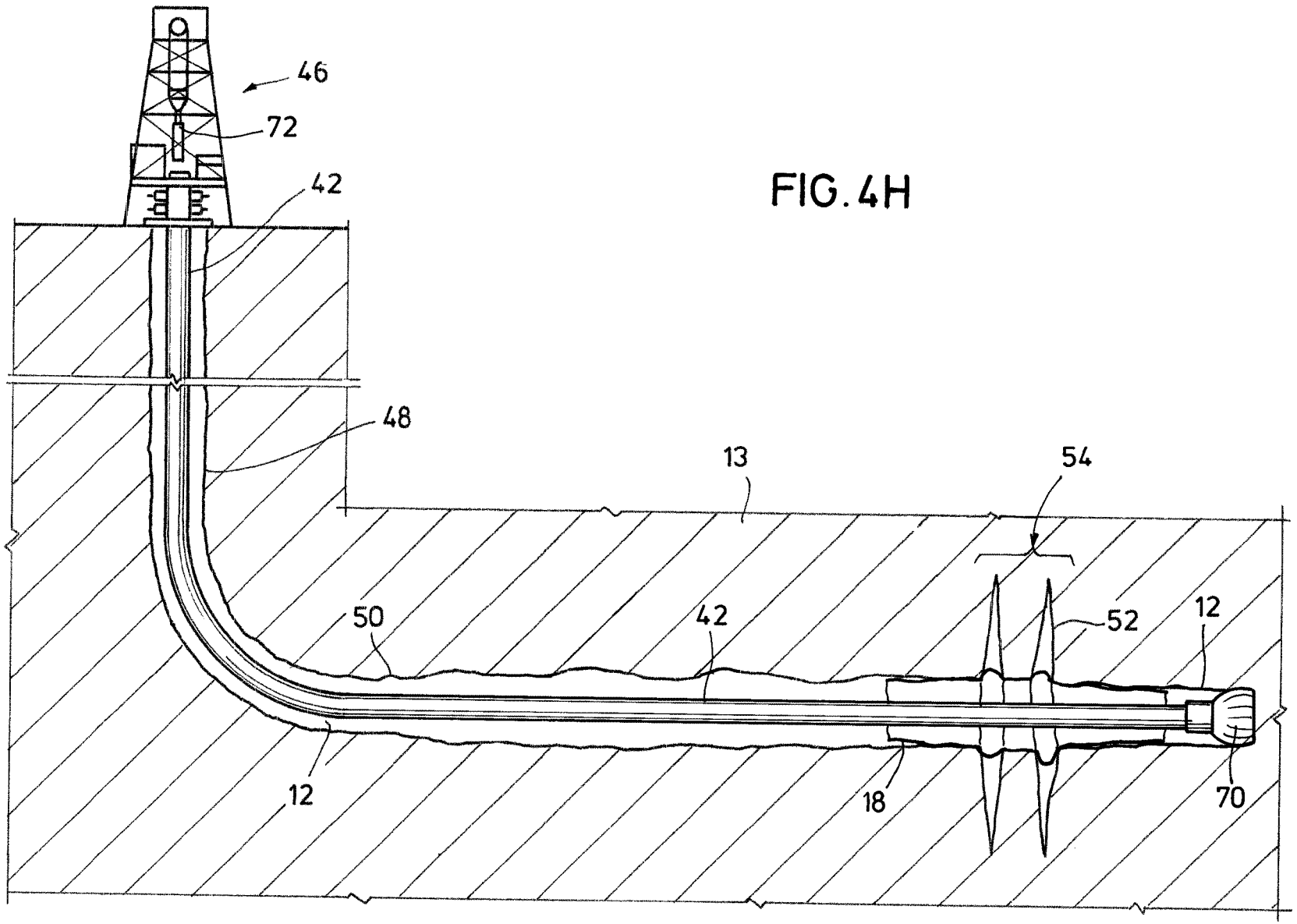
FIG. 4H is a side sectional view of an example of deepening the wellbore past the liner.

Illustrated in a side partial sectional view in FIG. 4G is an example of the liner 18 being set and deployed within wellbore. As indicated above, the liner 18 is formed from a material that can withstand the normal operating pressures within wellbore 12 and prevent flow of fluid of wellbore 12 into the fractures 52 or other portions of the lost circulation zone 54. Optionally, as shown in side partial sectional view in FIG. 4H, the liner shoe 34 of FIG. 4G can be removed with a drill bit 70 shown mounted on a lower end of a drill string 42. In the example of 4H, a top drive 72 shown within drilling rig 46 provides rotational force to the drill pipe 42. However, other means of rotating drill pipe 42 can be employed for rotating the bit 70 and thereby removing the liner shoe 34 of FIG. 4G.

Figure 5A:
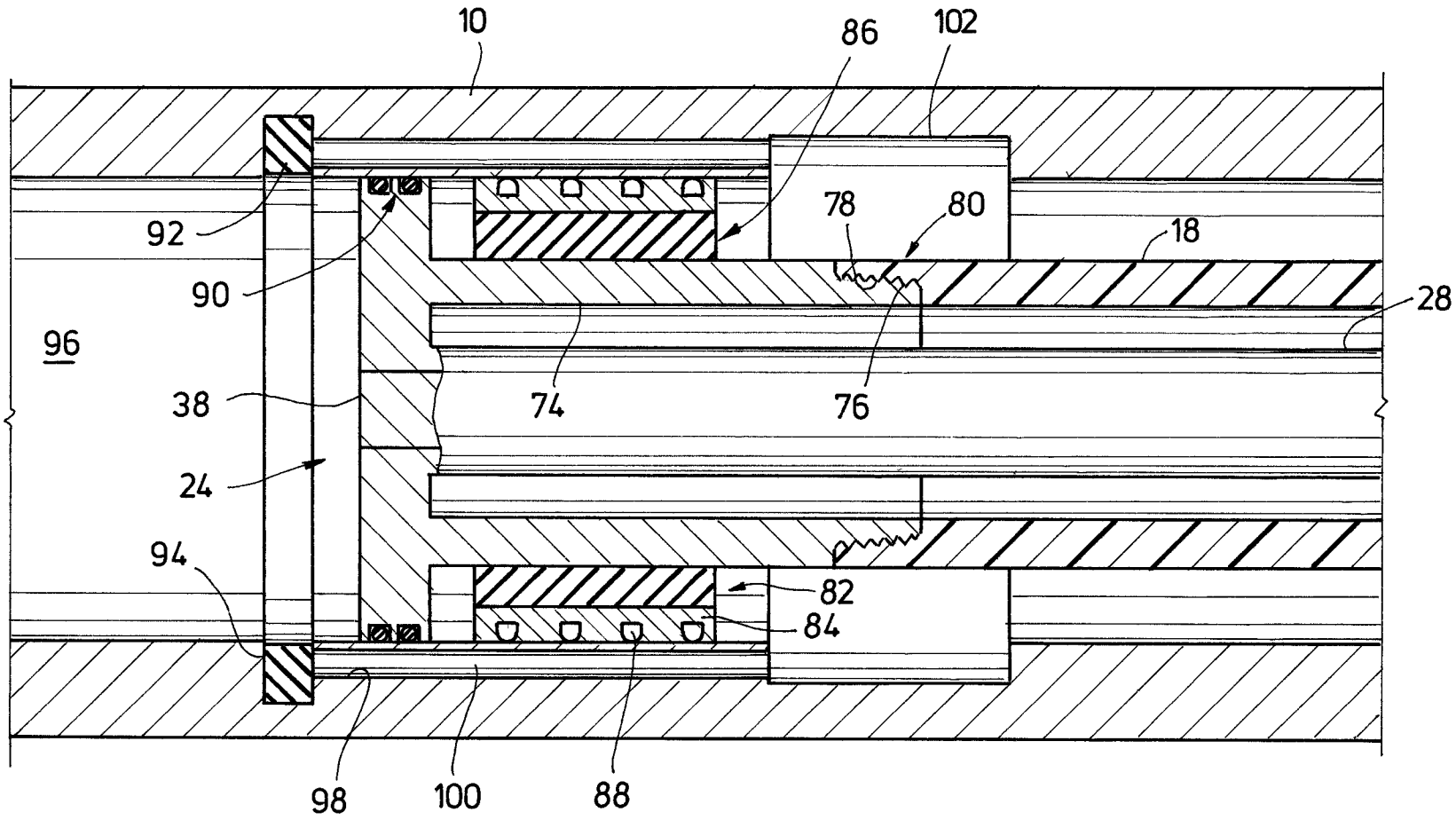
FIGS. 5A-5C are side sectional views of an example of operation of a piston locking mechanism for use with the bottom hole assembly of FIG. 3.
Figure 5B:
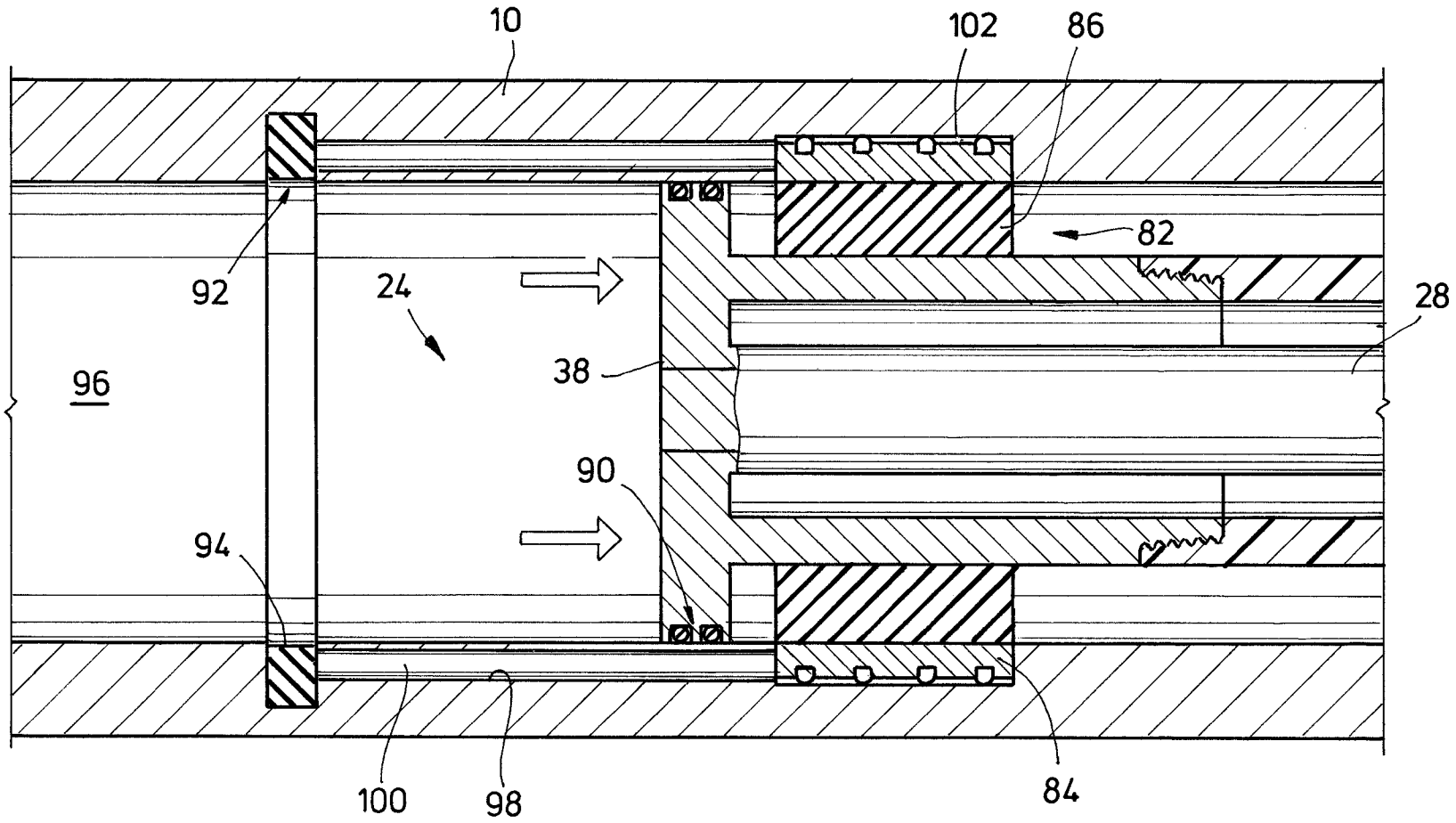
Figure 5C:
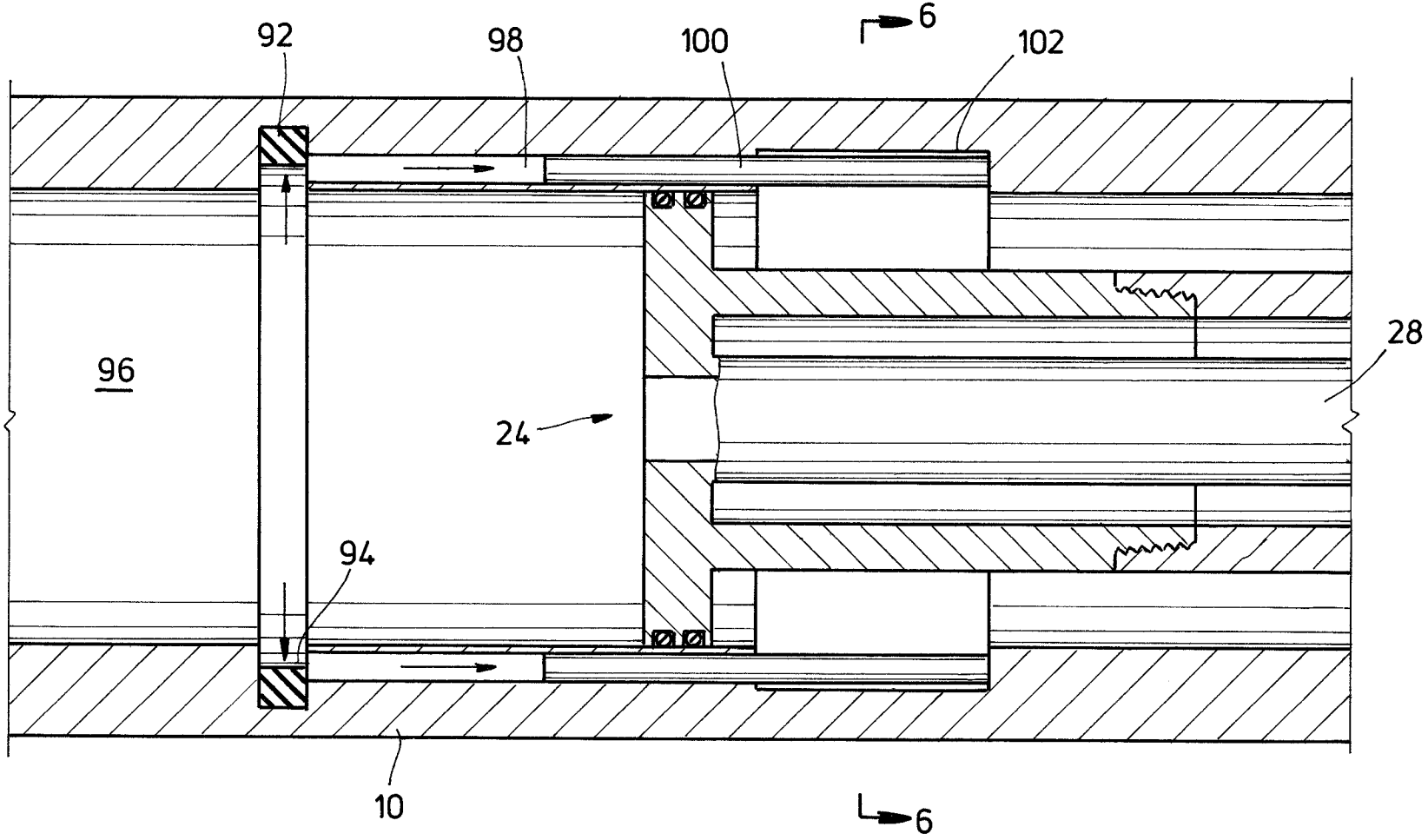

FIG. 5A through 5C illustrate one example operation of a mechanism for latching together the piston assembly 24 and housing 10. Here, the piston assembly 24 is shown having an annular pedestal 74 that couples generally coaxially on a side of piston head 38 that faces liner 18. Pedestal 74 has a pin end 76 on its lower terminal end which is distal from piston head 38. Pin end 76 connects with a box end 78 shown provided on an upper end of liner 18 and proximate the pin end 76. Threads are provided on the pin end 76 and box end 78 that when engaged form a threaded connection 80 which provides releasable connectivity between piston assembly 24 and liner 18. Further provided in the illustrated example are dog assemblies 82 mounted on an outer wall of pedestal 74. As shown, the dog assemblies 82 include dog members 84 that are in contact with an inner wall of housing 10, and resilient members 86 between dog members 84 and an outer surface of pedestal 74. In an example, the resilient members 86 urge the dog members 84 radially outward. Rollers 88 are optionally provided on a surface of dog members 84 adjacent an inner surface of housing 10 which facilitate sliding of the piston assembly 24 within housing 10. Optional seals 90 are shown that circumscribe piston head 38 and which define a pressure barrier between the piston head 38 and inner surface of housing 10.

Further illustrated in FIG. 5A are pressure disks 92 that are disposed in cavities 94 formed in a sidewall of housing 10. Cavities 94 are in communication with a bore 96 shown extending axially through housing 10. In the example of FIG. 5A, the cavities 94 are on a side of piston head 38 opposite from the dog assemblies 82. Axial passages 98 extend from a side of cavities 94 through sidewall of housing 10. Rods 100 are set in the passages 98 and which each have a length similar to a length of its corresponding passage 98. The passages 98 terminate in a channel 102 shown formed in the sidewall of the inner surface of housing 10, and which extends radially outward from bore 96. Optionally, channel 102 extends the full inner circumference of housing 10. In the example of FIG. 5A, assemblies 82 are between cavities 94 and channel 102. Channel 102 is optionally sized with an axial length to accommodate piston assemblies 82 within.

Referring now to FIG. 5B shown in a side partial sectional view is an example of pressurizing bore 96 so that piston assembly 24 moved axially within housing 10 in a direction away from cavities 94 and pressure disk 92. Sufficient axial movement of the piston assembly 24 urges the dog assemblies 82 into registration with channel 102. When registered, the dog members 84 are urged radially outward and into channel 102 by the presence of the resilient members 86. Examples of resilient members 86 include springs, pneumatics, as well as elastomeric members. Inserting the dog members 84 into the channel 102 axially couples the piston assembly 24 to the housing 10 thereby restricting further sliding of piston assembly 24. In an example, the position of the piston assembly 24 in housing 10 of FIG. 5A is substantially the same as the position illustrated in the deployed configuration of FIG. 4B. Further pressurization of the bore 96, as illustrated in the example of FIG. 5C, compresses the pressure disk 92 which allows communication between bore 96 and passages 98. Applying the pressure onto the ends of rods 100, forces the rods 100 axially within the sidewall of housing 10 in a direction away from cavities 94. Some of the rods 100 are azimuthally offset from the dog members 84 and thus can enter into the channel 102. In this configuration, the rods 100 that are able to enter the channel 102 are adjacent lateral edges of the dog assemblies 82 of FIG. 5B thereby providing a rotational coupling between the housing 10 and piston assembly 24. In an alternative, flow is ported through piston assembly 24 and into body 28 through a bore in the piston.

Figure 6:
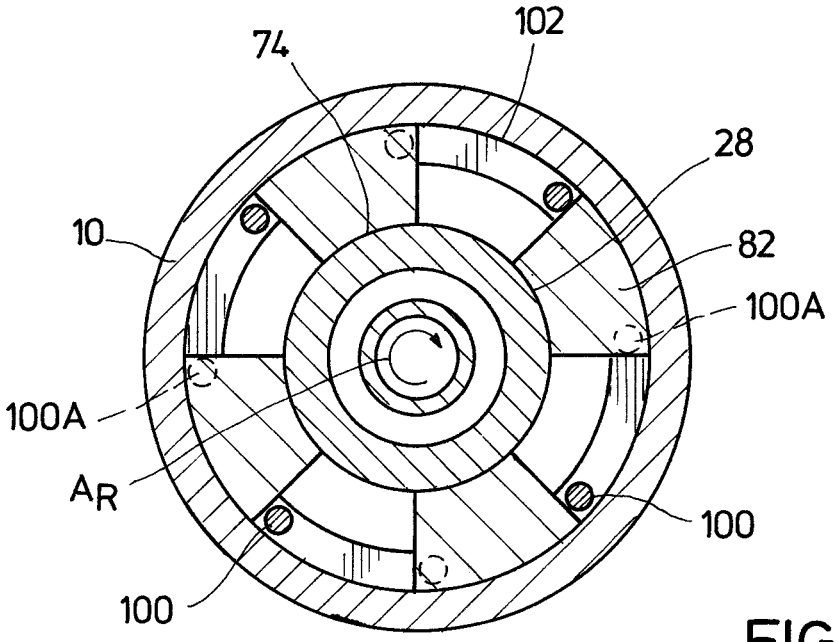
FIG. 6 is an axial view of an example of the bottom hole assembly and taken along lines 6-6 of FIG. 5C.

Referring now to FIG. 6, illustrated in an axial view and taken along line 6-6 of FIG. 5C, are the rods 100 adjacent the lateral sides of the dog assemblies 82. Here, rods 100A shown in a dashed outline represent position of rods 100A when rods 100A are spaced axially away from channel 102, such as in FIG. 5B. Subsequently, rods 100A are urged axially and into channel 102, and as illustrated by rods 100 having the solid outline form. Thus by applying a rotational force $A_R$ to pedestal necessarily then transfers the force onto housing 10 via the interference of the dog members 82 and the rods 100. Accordingly, the pedestal 74 can be disconnected from liner 18 by applying rotational force $A_R$ to housing 10 to decouple the threaded connection 80 of FIG. 5A.

Figure 7A:
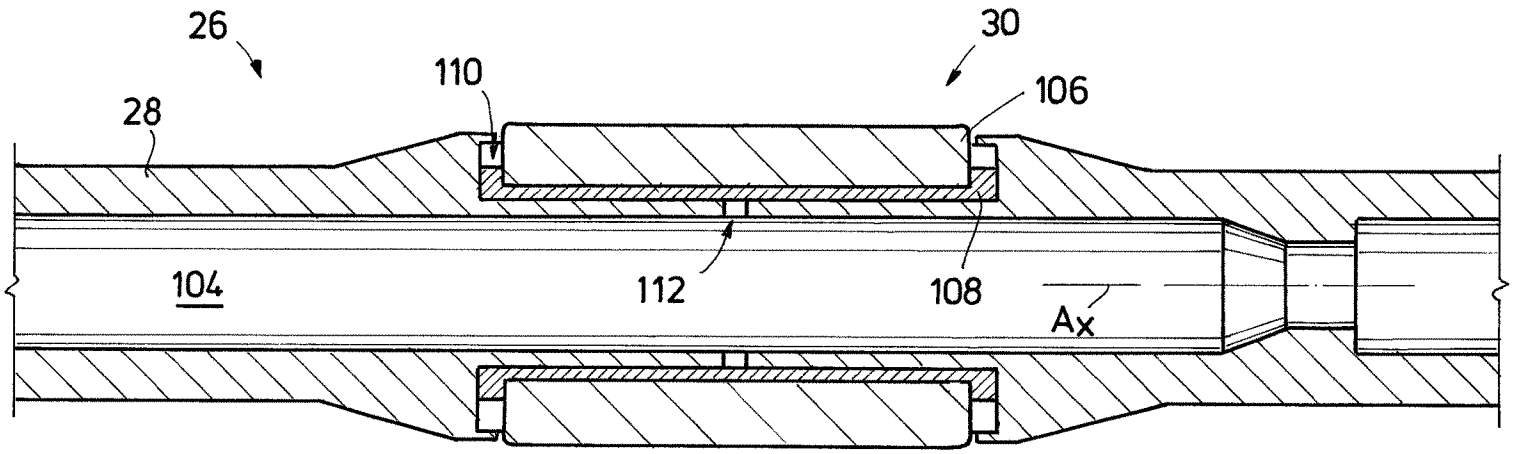
FIGS. 7A and 7B are side partial sectional views of an example of operational steps of an expander for use with the bottom hole assembly of FIG. 3.
Figure 7B:
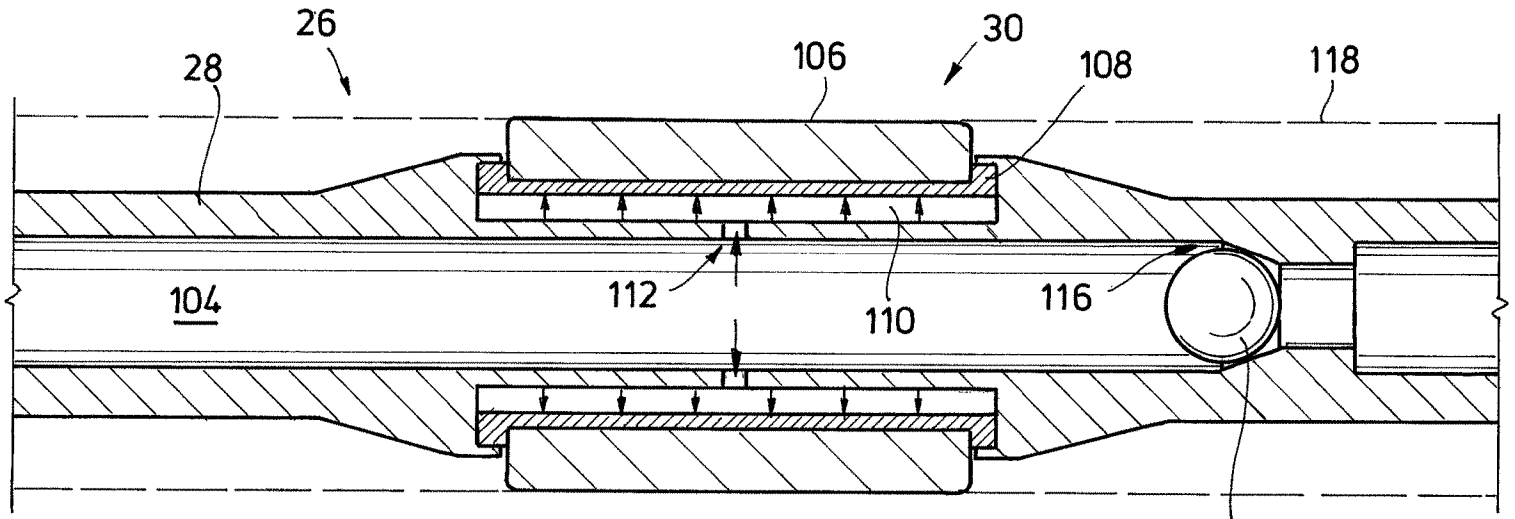

FIGS. 7A and 7B show in a side partial sectional view an example of deploying the expander 30 radially outward from deployment system 26. As shown in FIG. 7A, the expander 30 includes a cylindrical roller 106 that is mounted in orientation that is generally parallel within axis $A_X$ of body 28. Roller 106 mounts within a carriage 108 and is rollable with respect to carriage 108. Slots 110 are shown formed within an outer surface of body 28 and strategically formed to receive the carriage 108 and roller 106. Further, a bore 104 projects axially within body 28 and which is selectively in fluid communication with drill pipe 42 of FIG. 4B. Additionally, a port 112 extends from an outer wall of bore 104 and into communication with an inner radial portion of slots 110. As shown in FIG. 7B, a ball 114 has been deployed downhole and which lands within a ball seat 116 formed within bore 104 and defined where the radius of bore 104 projects radially inward to have a radius less than that of ball 114. When seated in ball seat 116 ball 114 defines a flow barrier within bore 104. Thus with ball 114 set in ball seat 116, pressure within slots 110 is increased by adding a pressurizing fluid to bore 104. Pressurizing slots 110 in turn urges carriages 108 and rollers 106 radially outward. Further illustrated in FIG. 7B is how an outer periphery of roller 106 extends past its position of FIG. 7A and to a designated diameter 118. In one example, the designated diameter 118 is at a location that by contacting the rollers 106 and their configuration of FIG. 7B with the inner surface of liner 18 of FIG. 4F in turn urges liner 18 against sidewalls of wellbore 12 thereby conforming liner against wellbore 12.

Figure 8A:
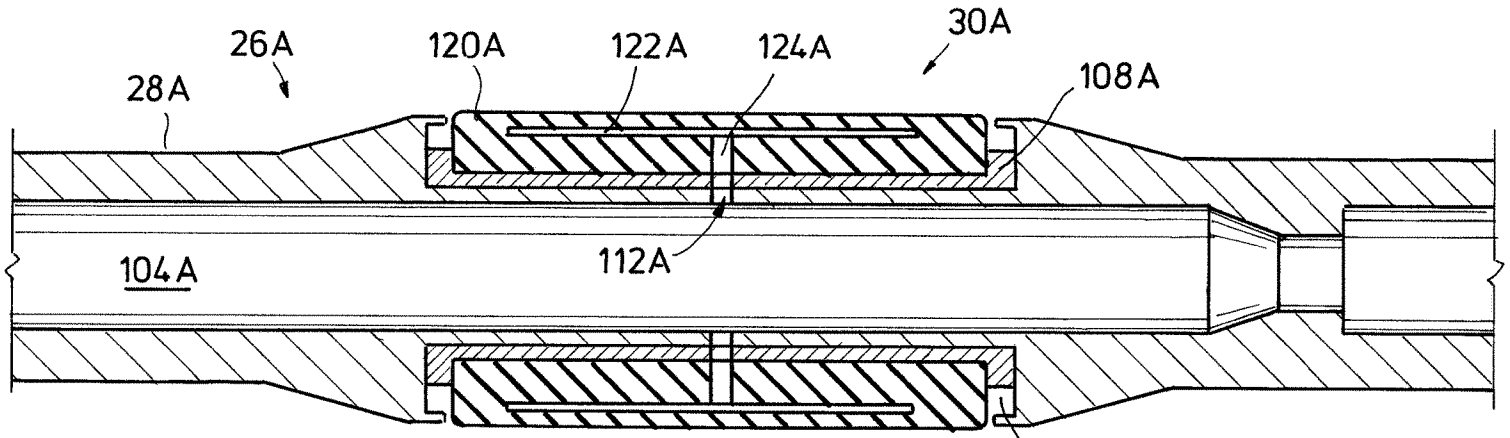
FIGS. 8A and 8B are side partial sectional views of an example of operational steps of an alternate embodiment of an expander for use with the bottom hole assembly of FIG. 3.
Figure 8B:
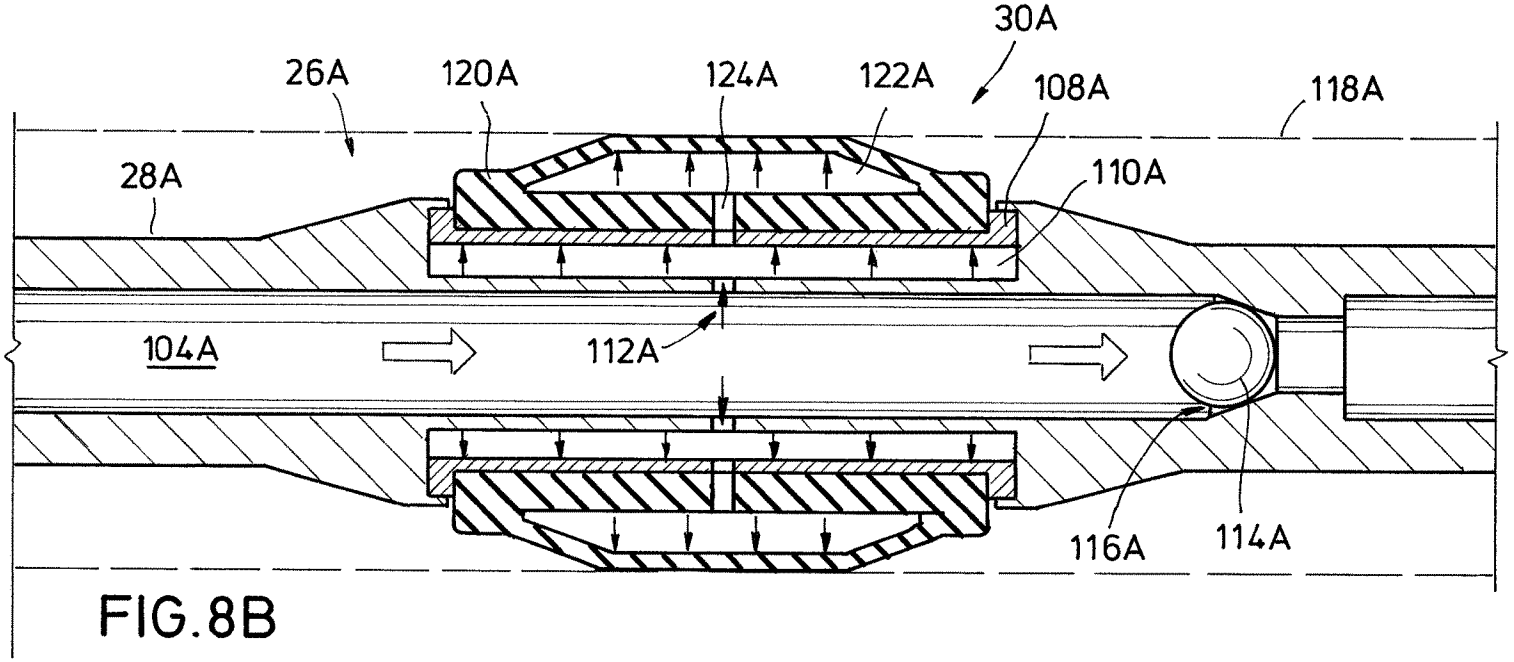

An alternative example of the expander 30A is shown in partial side sectional views in FIGS. 8A and 8B. In this example, instead of the rollers 106 of FIGS. 7A and 7B, a packer 120A is provided in carriage 108A that is set in slots 110A. Here the packer 120A can optionally be formed by elastomeric material and include a chamber 122A within that is in fluid communication with bore 104A via port 112A and inlet 124A. Similarly, a ball 114A is shown dropped into a ball seat 116A of FIG. 8B so that subsequently pressurizing the bore 104A communicates pressurized fluid into chamber 122A via port 112A and inlet 124A. Not only is the carriage 108A and packer 120A urged radially outward, the chamber 122A is filled with pressurized fluid so that the outer diameter of packer 120A is substantially in line with the designated diameter 118A and for being put into conforming contact with liner 18.

Figure 9:
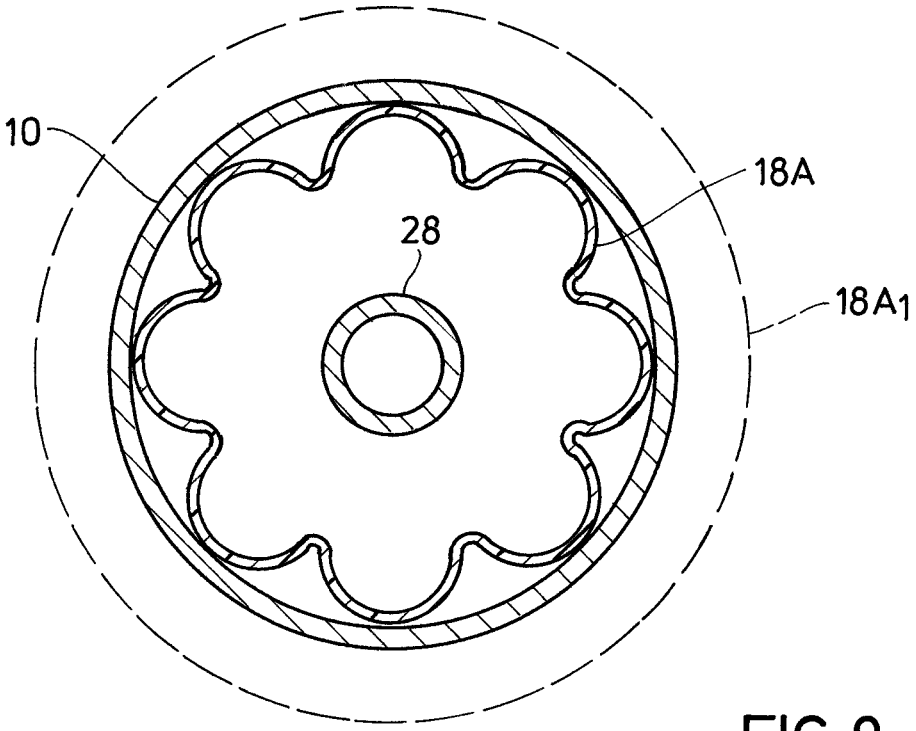
FIG. 9 is an axial sectional view of an example of the bottom hole assembly of FIG. 3 and taken along lines 9-9.

FIG. 9 shows in an axial sectional view an example of liner 18A and set within housing 10 and being deployed within a wellbore 12. In this example, the liner 18A has a cross section that is undulating and so that it can fit within housing 10 when in its unexpanded state. A dashed circular line represents an outer diameter of the deployed or set liner 18$A_1$ and which projects outside of housing 10. Optionally, to achieve a lower diameter configuration during deployment the liner 18A can be twisted into a helical configuration and with the undulations projecting in a helix like fashion along the length of the liner 18A.

In one example of operation the steps involved are as follows. The bottom hole assembly 44 is deployed into the wellbore 12 with the protective housing 10, and supported with casing slips 14 at rig floor 16. The liner 18 is supported with hand slips 20 on top of a false rotary table (not shown). Deployment system 26 with its expander 30 is lowered into piston assembly 24 is connected to top of liner 18. In an example, the connection 80 between piston assembly 24 and liner 18 is a left hand thread. An advantage of the threaded connection 80 is increased sealing capability across the connection 80 Liner 18 is lowered and shear pins 36 are installed to hang the liner 18 in the protective housing 10. Make up cross-over 40 and deploy in the wellbore 12 on drill pipe 42, where liner 18 is protected by housing 10 while being run in hole. The bottom hole assembly 44 is lowered to bottom 62 to check that the planned setting depth section of liner 18 is free of obstruction. The drill pipe 42 with attached bottom hole assembly 44 is drawn up so that liner shoe 34 is at a designated depth. A ball (not shown) is dropped and pumped to its seat in the liner shoe 34. Then a pressure is applied to exert a sufficient hydraulic force to fracture shear pins 36. When the ball is no longer required, it can be removed by subsequent drilling. The pressure continues to be applied to push liner 18 out of housing 10 towards bottom 62. Piston assembly 24 engages a locking mechanism provided with housing 10 to axially couple piston assembly 24 and liner 18 with housing 10 and suspend further axial movement between piston assembly 24 and housing 10. Inside of body 28 is pressurized to a pressure exceeding a burst pressure of burst disks 64 installed on sidewalls of body 28. Flowing pressurized fluid through burst disks 64 and into sealed space 35 inflates/radially expands liner 18. Maintain pressure inside sealed space 35 for a period of time, such as for example about 30 minutes, to radially expand liner 18 so that the liner 18 conforms to contours along sidewall of wellbore 12. Pressure in drill pipe 42, body 28, and sealed space 35 is bled off at surface. During depressurization a flow-check can be performed, that in one example is well static to determine if flow is still being lost in lost circulation zone 54. If losses are not cured, then reintroduce pressure into sealed space via drill pipe 42, and move drill pipe 42 slightly up or down to enable a better contact of ends of liner 18 with sidewalls of wellbore 12. Also draw drill pipe 42 slightly upward to check if the liner 18 is fully expanded and anchored across the lost circulation zone 54. Decouple bottom hole assembly 44 from liner 18, and draw drill pipe 44 upward so that the expander 30 is below the open end 69 of liner 18. Rotating the work string clockwise decouples the bottom hole assembly 44 from liner 18 due to the left hand threaded connected between liner 18 and assembly 14. Drop a second ball 114, which has a larger diameter than the first ball (not shown) and land ball 114 in ball seat 116 to create flow barrier. Apply hydraulic pressure to activate expander 30, meanwhile rotate the drill pipe 42 to further expand the open end 69 of liner 18 so to enable a quick and better pressure seal of lost circulation zone 54. A drift run can also be optionally performed. In one example, a drift run includes a test run to check the condition of the expanded flexible liner, in one operational embodiment, the expander 30 is run to the bottom setting depth to ensure sufficient space available to subsequent drilling pass-through. Bottom hole assembly 44 can be removed from wellbore 12, liner shoe 34 is drilled out, and drilling continued.

Advantages of the system and method described herein include the protective housing 10 which significantly reduces risk of damage to the liner 18 while being deployed downhole. Design of the liner 18 provides for a simple and quick installation and setting. Liner 18 can also be quickly removed by milling in case of failure to remediate the lost circulation zone 54. The operating procedure is simple and straightforward, and easy to verify the liner 18 expansion and anchor before releasing running tool system. Further, the mechanical solution provided herein does not require special LCM or cement, hence less formation damage (if loss zone is inside reservoir). Deployment of the bottom hole assembly 44 also allows for circulation and rotation while running in hole; which can be accomplished like other operations while drilling, and which includes circulation of fluid from surface within drill pipe 42, down to the piston face, the inner string within the liner 18 and through liner shoe 34 and returning to surface in the annulus between the string and the wellbore 12. In an operational example, drill pipe 42 is rotated, such as from a rotary table or top drive on surface (not shown). A cross-over to the protective housing 10 is optionally included and that has a threaded connection for rotating the housing 10 without subjecting the flexible liner 18 to rotational stress and strain. Incorporating a roller expander to assist fully expanding the top of flexible skin liner for a better seal and drift same or whole flexible liner post expansion, so it is one-trip deployment system.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of conducting operations in a wellbore comprising:

handling a bottom-hole assembly in the wellbore that comprises an annular housing, and includes a tubular liner inserted within the housing;

deploying the tubular liner from within the housing and adjacent to a lost circulation zone in the wellbore;

urging the liner radially outward into contact with sidewalls of the wellbore;

conforming the liner with a contour of the wellbore by pressing the liner against the sidewalls of the wellbore to remediate the lost circulation zone; and the liner is threadingly attached to a piston assembly that is in the housing and adjacent the liner, and where deploying the liner comprises pressurizing the housing on a side of the piston assembly opposite the liner to urge the liner from the housing.

2. The method of claim 1, further comprising extending a drill bit through the liner and deepening the wellbore.

3. The method of claim 1, wherein the liner material comprises interstitial free steel having a tensile strength of around 30,000 pounds per square inch.

4. The method of claim 1, wherein urging the liner radially outward comprises pressurizing an inside of the liner.

5. The method of claim 1, wherein the step of conforming the liner with a contour of the wellbore comprises applying a mechanical force against an inner surface of the liner.

6. The method of claim 1, wherein the step of conforming the liner with a contour of the wellbore comprises bulging the liner radially outward into a fracture that extends into a formation surrounding the wellbore.

7. The method of claim 1, further comprising providing a protective housing around the liner while deploying the liner into the wellbore.

8. The method of claim 7, wherein the liner and housing comprise a portion of a bottom hole assembly, the method further comprising applying pressure to the bottom hole assembly to project the liner axially from an open end of the housing.

9. The method of claim 1, wherein the housing comprises a bore, a sidewall circumscribing the bore, a cavity formed in the sidewall of the housing and that extends along a length of the housing, a pressure disk disposed at an interface between the cavity and the bore, a channel formed in the sidewall that is in communication with the bore and the cavity, and an elongated rod in the cavity, and where a dog is disposed in the bore on a side of the piston assembly facing the liner, the method further comprising, pressurizing the bore so that, the pressure disk is actuated to provide communication between the bore and the cavity, the rod is urged through the cavity and into the channel, and the piston assembly is urged towards the channel to drive the dog into the channel and adjacent the rod thereby rotationally coupling the housing and the piston assembly;

decoupling the piston assembly from the liner by rotating the housing; and removing the piston assembly and housing from the wellbore.

10. A system for use in conducting operations in a wellbore comprising:

an annular housing;

a piston assembly in the housing and moveable from a first location in the housing to a second location in the housing that is spaced axially away from the first location;

an annular liner detachably attached to the piston assembly and selectively disposed in the housing when the piston assembly is in the first location and outside of the housing when the piston is in the second location;

a liner shoe on an end of the liner distal from the piston assembly and which defines a sealed space within the liner and between the piston assembly and the liner shoe, so that when pressure is applied to the sealed space, the liner expands radially outward into contact with an inner surface of the wellbore; and the liner is threadingly attached to a piston assembly that is in the housing and adjacent the liner, and where deploying the liner comprises pressurizing the housing on a side of the piston assembly opposite the liner to urge the liner from the housing.

11. The system of claim 10, wherein the liner is formed from a material having a tensile strength of about 30,000 pounds per square inch, so that by applying pressure to the sealed space the liner conforms to a profile of sidewalls of the wellbore, and bulges into fractures that extending from the sidewalls and into a formation that surrounds the wellbore.

12. The system of claim 10, further comprising an expander that selectively expands into contact with the liner to mold the liner against sidewalls of the wellbore.

13. The system of claim 10, wherein an end of the housing is in communication with a pressure source, so that when pressure is supplied from the pressure source, the piston is slidingly urged within the housing to deploy the liner from within the housing, and wherein the piston assembly comprises a piston that attaches to an end of the liner distal from the liner shoe.

14. The system of claim 10, further comprising a tubular member having an end attached to the piston assembly and extending into the liner, and a burst disk on the tubular member, so that when pressure is supplied to the tubular member that exceeds a burst pressure of the burst disk, pressure is applied to an inside of the liner that radially expands the liner into conforming contact with sidewalls of the wellbore.

15. The system of claim 10, further comprising a dog assembly mounted onto the piston assembly, and that projects radially outward into a profile formed on an inner circumference of the housing.

16. The system of claim 15, wherein the dog assembly comprises a dog member and a resilient member that urges the dog member into the profile.

17. The system of claim 15, further comprising a pressure actuated rod that selectively moves axially adjacent the dog assembly thereby rotationally affixing the housing and the piston assembly.

18. The system of claim 17, further comprising, a cavity in a sidewall of the housing and in which the rod is disposed, the cavity having an end that intersects the profile, and a pressure disk selectively openable in response to pressurizing a bore in the housing and that is disposed in an end of the cavity distal from the profile.

19. The system of claim 10, wherein the piston assembly comprises a disk-like piston head, and an annular pedestal projecting axially from a side of the piston head, and wherein the liner threadingly attaches to an end of the pedestal distal from the piston head.

* * * * *